US011874065B2

(12) United States Patent
Lu et al.

(10) Patent No.: US 11,874,065 B2
(45) Date of Patent: Jan. 16, 2024

(54) COOLING WATER-SAVING DEVICE FOR COOLING TOWER, AND WET COOLING TOWER

(71) Applicant: CHONGQING UNIVERSITY, Chongqing (CN)

(72) Inventors: Xiaofeng Lu, Chongqing (CN); Xuchen Fan, Chongqing (CN); Quanhai Wang, Chongqing (CN); Jianbo Li, Chongqing (CN); Yinhu Kang, Chongqing (CN); Chenyang Zhao, Chongqing (CN); Zhonghao Dong, Chongqing (CN); Rongdi Zhang, Chongqing (CN)

(73) Assignee: Chongqing University, Chongqing (CN)

( * ) Notice: Subject to any disclaimer, the term of this patent is extended or adjusted under 35 U.S.C. 154(b) by 49 days.

(21) Appl. No.: 17/848,914

(22) Filed: Jun. 24, 2022

(65) Prior Publication Data

US 2023/0204293 A1 Jun. 29, 2023

(30) Foreign Application Priority Data

Dec. 24, 2021 (CN) ..... 202111598249.3

(51) Int. Cl.
*F28C 1/14* (2006.01)

(52) U.S. Cl.
CPC ..... *F28C 1/14* (2013.01)

(58) Field of Classification Search
CPC ..... F28C 1/14
USPC ..... 261/160, 161, DIG. 11
See application file for complete search history.

(56) References Cited

U.S. PATENT DOCUMENTS 4,626,387 A * 12/1986 Dodds ..... F28B 1/06 261/153
4,784,810 A * 11/1988 Jorzyk ..... F28F 25/12 261/DIG. 11
2007/0241468 A1* 10/2007 Kammerzell ..... F28C 1/14 261/153

FOREIGN PATENT DOCUMENTS

CN 214010061 U * 8/2021
KR 102335845 B1 * 12/2021

OTHER PUBLICATIONS

Partial English Translation of CN 214010061 U (Year: 2021).*
Partial English Translation of KR 102335845 B1 (Year: 2021).*

* cited by examiner

*Primary Examiner* — Charles S Bushey
(74) *Attorney, Agent, or Firm* — Katten Muchin Rosenman LLP

(57) ABSTRACT

Disclosed are a cooling water-saving device for a cooling tower, and a wet cooling tower. The cooling water-saving device includes indirect heat exchange devices and a water collecting tank. The inner wall of a cooling tower shell is sealed by the water collecting tank. The indirect heat exchange device includes a heat exchange channel and a heat insulation channel. The heat insulation channel penetrates through the bottom of the water collecting tank, and the bottom inlet of the heat insulation channel communicates with air entering from the bottom of the cooling tower shell. The heat exchange channel for shielding water drops is arranged at the top outlet of the heat insulation channel, and the top of the heat exchange channel extends into an air outlet in the upper part of the cooling tower shell. The lower outlet of the heat exchange channel communicates with a rain area.

20 Claims, 3 Drawing Sheets

COOLING WATER-SAVING DEVICE FOR COOLING TOWER, AND WET COOLING TOWER

CROSS REFERENCE TO RELATED APPLICATION

This patent application claims the benefit and priority of Chinese Patent Application No. 202111598249.3, filed on Dec. 24, 2021, the disclosure of which is incorporated by reference herein in its entirety as part of the present application.

TECHNICAL FIELD

The present disclosure relates to a wet cooling tower.

BACKGROUND ART

With reference to FIG. 1, shown is a conventional wet cooling tower 100 that mainly comprises a cooling tower shell 2, and a reservoir 101, a water return pipe 7, a cooling tower filler 10, a spray device 5, a water supply pipe 4 and a water eliminator 3 are sequentially arranged from bottom to top; and an exhaust fan is further arranged at the tops of some parts. The periphery of the cooling tower shell 2 is supported on the ground. The reservoir 101 is arranged on the ground (the bottom is waterproof), the water return pipe 7 is installed on the side face of the reservoir 101, the cooling tower filler 10, the spray device 5, the water supply pipe 4 and the water eliminator 3 are all installed on a concrete support, and the concrete support is supported on the ground of the reservoir. For a coal motor unit of an electric power system, the cooling tower plays a role in reducing the outlet temperature of water discharged from the cooling tower so as to reduce the back pressure of a steam turbine and improve the power capacity of steam.

The wet cooling tower is widely applied to the fields needing a large amount of cold sources, such as electric coal motor units, chemical engineering and metallurgy. Circulating water in the wet cooling tower is in direct contact with air. Heat in the water is transferred to the air through heat transfer by air contact and heat dissipation by evaporation. The cooling effect of the wet cooling tower is theoretically limited by the wet bulb temperature of the ambient air, and the limiting temperature for cooling the water is the wet bulb temperature of the ambient air; and in practical engineering, the conventional wet cooling tower can only cool circulating water to 3-5° C. higher than the wet bulb temperature of ambient air. Meanwhile, the circulating water loss caused by evaporation in the wet cooling tower is a major factor of the water loss of the cooling tower and is also the cause of the largest water consumption in the project of the coal motor unit. Consequently, the water consumption of the cooling tower causes great economic loss. In addition, as the reservoir is arranged at the bottom of the cooling tower shell and the lifting height of circulating water in the cooling process is high, the running power consumption of the cooling tower is large.

The conventional wet cooling tower has the problem that the outlet temperature of water discharged from the cooling tower cannot be reduced below the wet bulb temperature of ambient air, so that the cloud water loss is large and the running power consumption is high. The cloud water refers to water mist discharged from the upper part of the cooling tower.

It is well known that the air temperatures refer to dry bulb temperature, wet bulb temperature and dew point temperature. The dry bulb temperature is the temperature measured by a common air thermometer. The wet bulb temperature is the temperature corresponding to the point where air intersects with a saturated humidity line along an isenthalpic line, namely the lowest temperature that can be reached by the current environment only by evaporating moisture. The dew point temperature is the temperature corresponding to the point where the air intersects with the saturated humidity line along the isohygrometric line, namely the temperature at which dewdrops are formed. According to the relationship of the three temperatures, the dry bulb temperature is greater than the wet bulb temperature, and the wet bulb temperature is greater than the dew point temperature.

SUMMARY

Aiming at the problems in the prior art, the technical problem to be solved by the present disclosure is to provide a cooling water-saving device for a cooling tower. The cooling water-saving device can reduce the temperature of the ambient air to be below the wet bulb temperature, so that the utilization efficiency of electric coal is improved, and the consumption of electric coal is reduced. In addition, the cloud water loss of the wet cooling tower and the power consumption of the circulating water pump can be reduced. The present disclosure further provides a wet cooling tower which is provided with the cooling water-saving device.

In order to solve the technical problem, a cooling water-saving device for a cooling tower provided by the present disclosure comprises indirect heat exchange devices and a water collecting tank. The inner wall of a cooling tower shell is sealed by the water collecting tank. The indirect heat exchange device comprises a heat exchange channel and a heat insulation channel. The heat insulation channel penetrates through the bottom of the water collecting tank. The bottom inlet of the heat insulation channel communicates with air entering from the bottom of the cooling tower shell. The heat exchange channel for shielding water drops is arranged at the top outlet of the heat insulation channel. The top of the heat exchange channel extends into an air outlet in the upper part of the cooling tower shell, and the lower outlet of the heat exchange channel communicates with a rain area.

Preferably, the cooling water-saving device is arranged on the support frame. The support frame is supported on the lower bottom face of the water collecting tank from the ground, and the indirect heat exchange device sequentially penetrates through the water collecting tank, a spray device, a water distribution pipe and a water eliminator from bottom to top.

A wet cooling tower provided by the present disclosure comprises a cooling tower shell, a support frame, a water return pipe, a spray device, a water distribution pipe and a water eliminator which are arranged in the cooling tower shell from bottom to top, and an air inlet is formed in the bottom of the cooling tower shell. The wet cooling tower further comprises the cooling water-saving device. The cooling water-saving device is supported on the ground through the support frame. The top of the cooling water-saving device extends into an air outlet in the upper part of the cooling tower shell. A cooling tower air inlet is formed in the lower part of the cooling water-saving device, and a rain area is formed between the cooling water-saving device and the spray device.

As the indirect heat exchange device is used, the ambient air cools saturated moist air at the air outlet of the cooling tower shell at the upper part of the heat exchange channel, so that part of water steam in the saturated moist air is condensed into water and automatically falls into the water collecting tank, and the cloud water loss is reduced; the ambient air is dehumidified and cooled at the lower part of the heat exchange channel, so that the outlet temperature of water discharged from the cooling tower can be further reduced to be lower than the wet bulb temperature of the ambient air and even close to the dew point temperature; and by adopting the ground supported and bottom air inlet cooling water-saving device, the height of the bottom water collecting tank is increased, the free falling height of the rain area is reduced, and the circulating water supply power consumption of the cooling tower is saved.

Compared with the prior art, the device has the advantages that the outlet temperature of water discharged from the cooling tower is reduced, cloud water can be recycled, the water consumption of the wet cooling tower is reduced, and the power consumption of the circulating water pump is reduced.

BRIEF DESCRIPTION OF THE DRAWINGS

The preferred embodiments described herein and illustrated by the drawings hereinafter be to illustrate and not to limit the invention, where like designations denote like elements.

Reference signs: 1, cooling water-saving device; 11, indirect heat exchange device; 111, heat exchange channel; 112, heat insulation channel; 112*a*, cooling tower air inlet; 1121, air outlet; 12, water collecting tank; 121, wind shield; 122, bottom plate; 123, water receiving tank; 1221, through hole in bottom plate; 2, cooling tower shell; 2*a*, air outlet of cooling tower shell; 3, water eliminator; 4, water distribution pipe; 5, spray device; 6, rain area; 7, water return pipe; 8, support frame; 9, air inlet; 10, traditional cooling tower filler; and 101, traditional cooling tower reservoir.

DETAILED DESCRIPTION OF THE EMBODIMENTS

The present disclosure is further described in conjunction with the attached figures and embodiments.

Figure 1:
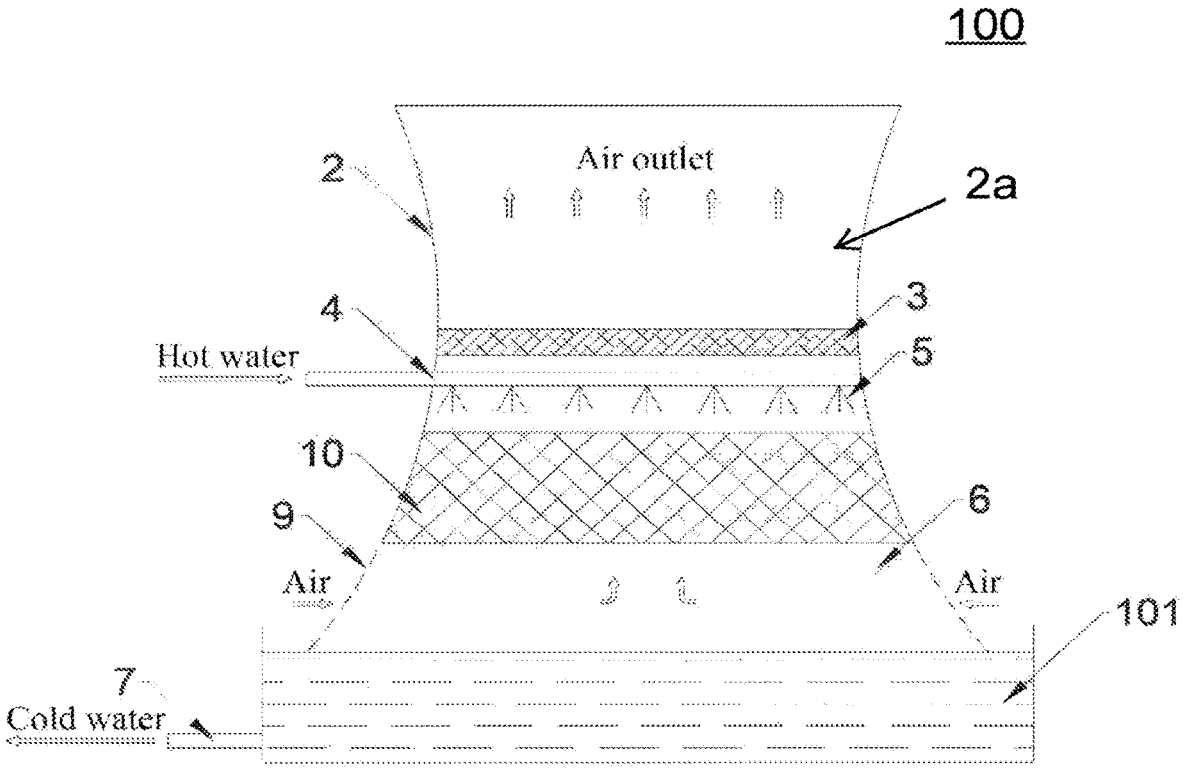
FIG. 1 Prior Art
FIG. 1 is a structural schematic diagram of a conventional wet cooling tower.
Figure 2:
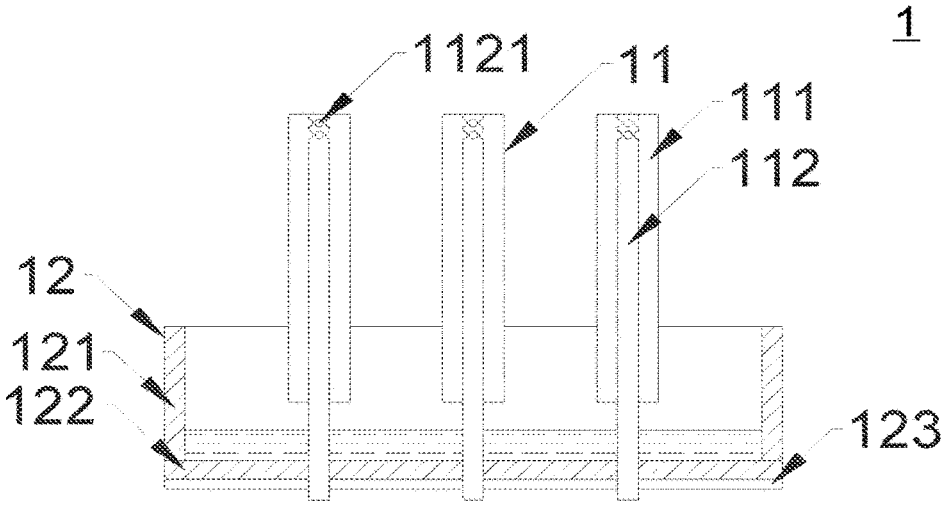
FIG. 2 is a structural schematic diagram of a cooling water-saving device in the present disclosure.

With reference to FIG. 2, shown is a cooling water-saving device 1 for a cooling tower in the present disclosure. The cooling water-saving device comprises indirect heat exchange devices 11 and a water collecting tank 12, wherein the inner wall of a cooling tower shell 2 is sealed by the water collecting tank 12 (see FIG. 5). The indirect heat exchange device 11 comprises a heat exchange channel 111 and a heat insulation channel 112. The heat insulation channel 112 penetrates through the bottom of the water collecting tank 12, and the bottom inlet of the heat insulation channel 112 communicates with air entering from the bottom of the cooling tower shell 2 (see FIG. 5). The heat exchange channel 111 for shielding water drops is arranged around the top outlet of the heat insulation channel 112. The top of the heat exchange channel 111 extends into an air outlet 2*a* in the upper part of the cooling tower shell 2, and the lower outlet of the heat exchange channel 111 communicates with a rain area 6 (see FIG. 5).

Figure 5:
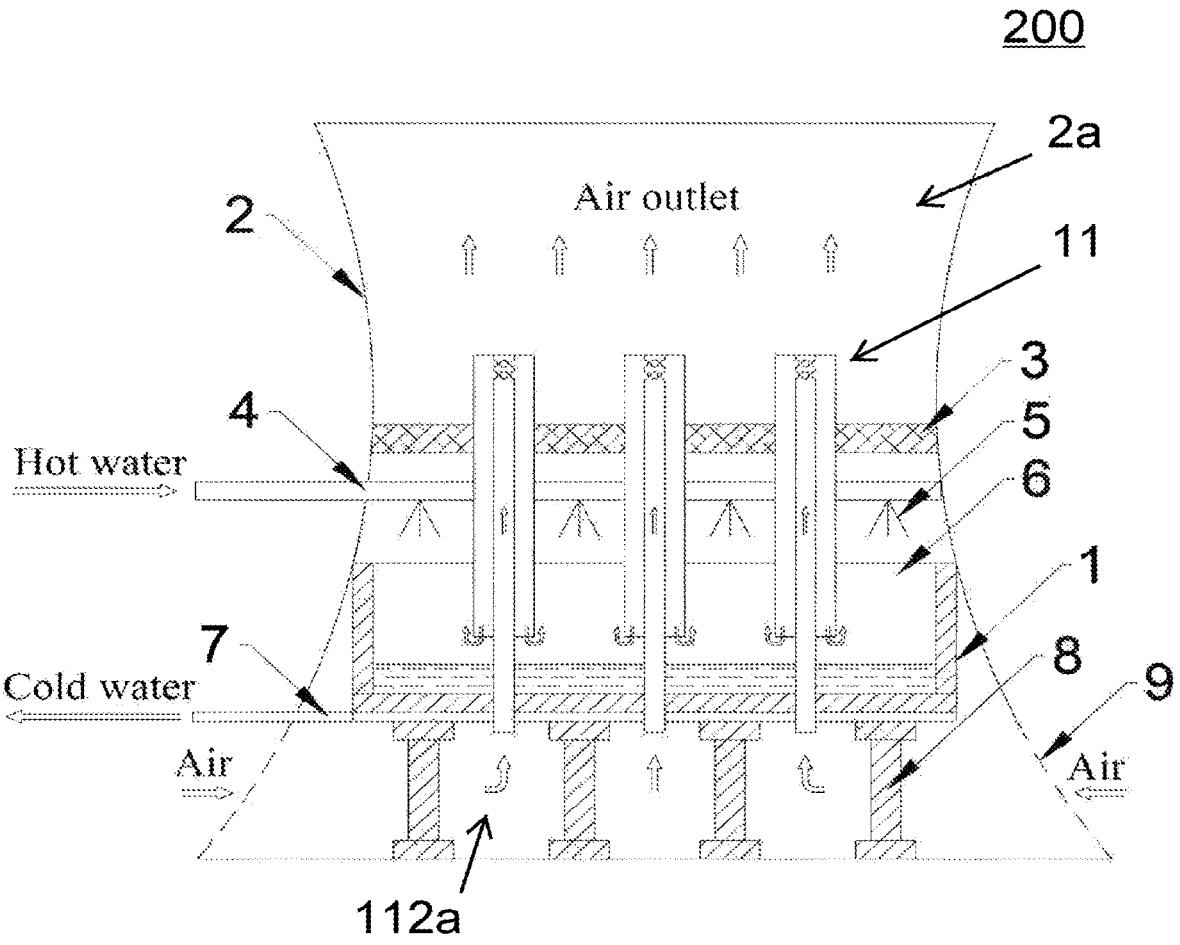
FIG. 5 is a structural schematic diagram of a wet cooling tower in the present disclosure.

Referring to FIG. 2 and FIG. 5, the cooling water-saving device 1 is arranged on the support frame 8, and the support frame 8 is supported on the lower bottom face of the water collecting tank 12 from the ground, so that power consumption of circulating water supply of the cooling tower is saved. The indirect heat exchange device 11 sequentially penetrates through the water collecting tank 12, a spray device 5, a water distribution pipe 4 and a water eliminator 3 from bottom to top, so that after saturated wet air at the air outlet of the atmospheric cooling tower shell is guided, ambient air is precooled through indirect heat exchange.

Figure 3:
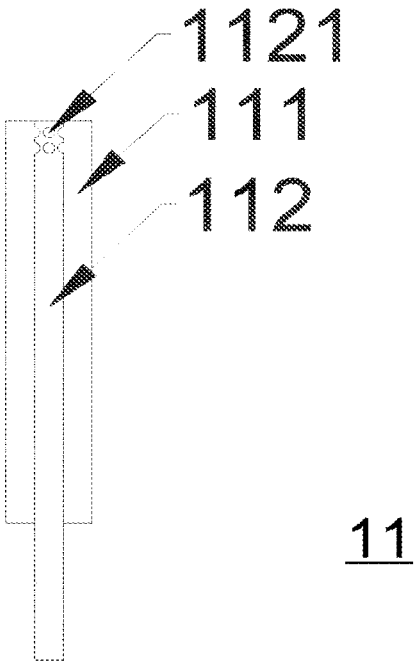
FIG. 3 is a structural schematic diagram of an indirect heat exchange device.

Referring to FIG. 2 and FIG. 3, the indirect heat exchange device 11 comprises a heat exchange channel 111 and a heat insulation channel 112. An air outlet 1121 is formed on the side end face of the upper portion of the heat insulation channel 112, and the top outlet of the heat insulation channel 112 is covered with the heat exchange channel 111 in a breathable manner. The heat exchange channel 111 comprises a closed upper end face, a closed side end face and a through lower end face, and the heat insulation channel 112 comprises a through upper end face, a through lower end face and a side end face with an air outlet 1121 formed in the top.

The working principle of the cooling water-saving device is as follows. According to an M-cycle indirect evaporative cooling process, air at the lower part of the cooling tower shell 2 enters the heat insulation channel 112 and then enters the heat exchange channel 111 of the indirect heat exchange device 11 through the air outlet 1121. In a dry channel higher than the water eliminator 3, the temperature of ambient air is lower than the temperature of saturated wet steam in the air outlet 2*a* of the cooling tower shell 2. Saturated wet steam in the air outlet 2*a* of the cooling tower shell 2 is cooled through sensible heat transfer, so that part of water steam in the saturated wet steam is condensed into water and automatically falls into the water collecting tank 12, and cloud water loss is reduced. The heat exchange channel 111 guides air to continuously flow downwards. In the dry channel located in the rain area 6, heat is transferred to the rain area 6 through sensible heat along the way to evaporate water steam. New moist air continuously makes contact with the pipe wall of the heat exchange channel 111 to complete more heat absorption and evaporation. By these processes, pre-cooling of the air is achieved. The pre-cooled air enters the rain area 6, and then water is further cooled to the temperature below the wet bulb temperature of ambient air. Compared with the prior art, the cooling water-saving device 1 can overcome the cooling limit of the outlet water temperature of a traditional cooling tower 100, namely the wet bulb temperature of ambient air. The water temperature is reduced to be close to the dew point temperature of ambient air. The cooling water-saving device 1 in the present disclosure is beneficial to reducing the water temperature of circulating water of the cooling tower. Consequently, the steam utilization efficiency of the steam turbine is improved, and energy is saved.

The heat insulation channel 112 guides ambient air to uniformly enter the heat exchange channel 111. The heat insulation channel 112 and the heat exchange channel 111 include, but are not limited to, circular tubes, rectangular tubes and polygonal tubes. The heat exchange channel 111 includes, but is not limited to, a light pipe, a threaded pipe, an inner finned pipe, or an outer finned pipe, made of materials including but not limited to aluminum, stainless steel, iron and other materials with good heat conduction performance. The heat insulation channel 112 include, but are not limited to, circular tubes, rectangular tubes, and polygonal tubes, made of materials including but not limited to materials with poor heat conduction performance such as plastics and glass fiber reinforced plastics. The equivalent outer diameter of the heat exchange channel 111 is 10-200 mm, the wall thickness of the heat exchange channel 111 does not exceed 2 mm, and the length of the heat exchange channel 111 is 2-10 m. The lower end face of the heat exchange channel 111 is at least 200 mm higher than the water surface in the water collecting tank 12, and the upper end face of the heat exchange channel 111 is at least 500 mm higher than the top of the water eliminator 3. The equivalent outer diameter of the heat insulation channel 112 is 5-100 mm, the wall thickness of the heat insulation channel 112 does not exceed 2 mm, and the length of the heat insulation channel 112 is 3-11 m. The length of the portion of the heat insulation channel 112, downwardly extending out of the through hole 1221 of the bottom plate 122 is 50-100 mm.

Figure 4:
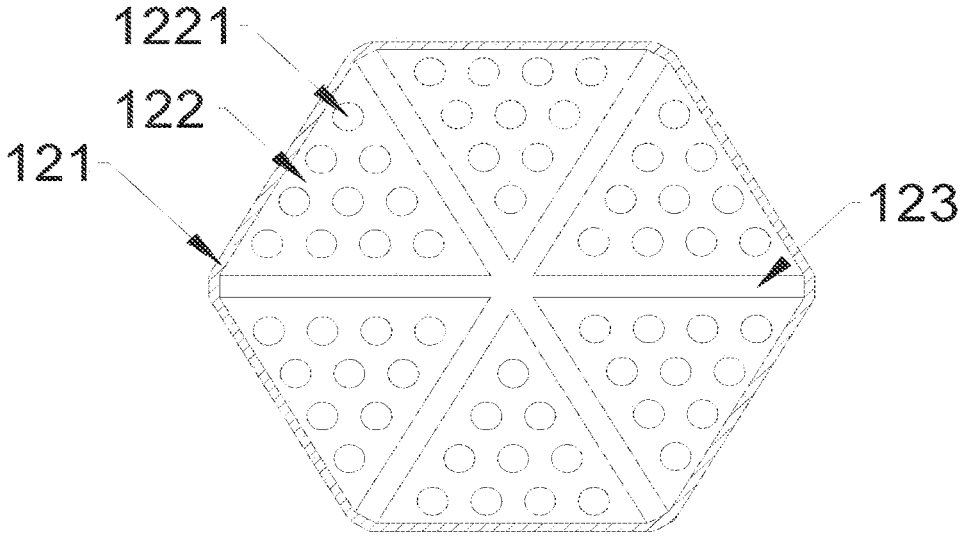
FIG. 4 is a top view of a water collecting tank.

Referring to FIG. 2 and FIG. 4, the water collecting tank 12 comprises a wind shield 121, a bottom plate 122 and a water receiving tank 123. The top edge of the wind shield 121 is in closed connection with the inner wall of the cooling tower shell 2 (see FIG. 5). The bottom edge of the wind shield 121 is connected with the periphery of the bottom plate 122. The water receiving tank 123 is distributed on the bottom plate 122. One end of the water receiving tank 123 is connected with the water return pipe 7. A through hole 1221 receiving the heat insulation channel 112 is formed in the bottom plate 122.

With reference to FIG. 5, shown is a wet cooling tower 200 in the present disclosure. The wet cooling tower 200 comprises a cooling tower shell 2, and further comprises a support frame 8, a water return pipe 7, a spray device 5, a water distribution pipe 4 and a water eliminator 3 which are arranged in the cooling tower shell 2 from bottom to top. The wet cooling tower 200 further comprises an air inlet 9 formed at the bottom portion of the cooling tower shell 2. The wet cooling tower 200 further comprises the cooling water-saving device 1. The cooling water-saving device 1 is supported on the ground through the support frame 8. The top of the cooling water-saving device 1 extends into an air outlet 2*a* at the upper part of the cooling tower shell 2. A cooling tower air inlet 112*a* is formed in the lower part of the cooling water-saving device 1. A rain area 6 is formed between the water collecting tank 12 of the cooling water-saving device 1 and the spray device 5. Ambient air enters the lower space of the water collecting tank 12 through the cooling tower air inlet 112*a* and uniformly enters the rain area 6 through the indirect heat exchange device 11.

The wet cooling tower 200 in the present disclosure effectively solves the problems that the cooling limit of the conventional wet cooling tower 100 is limited by the environmental wet bulb temperature, the cloud water loss is large, and the operation power consumption is high.

What is claimed is:

1. A cooling water-saving device for a cooling tower, comprising: indirect heat exchange devices and a water collecting tank, wherein an inner wall of a cooling tower shell is sealed by the water collecting tank, and the indirect heat exchange device comprises:

a heat exchange channel and a heat insulation channel, the heat insulation channel penetrates through a bottom of the water collecting tank, a bottom inlet of the heat insulation channel communicates with air entering from a bottom of the cooling tower shell, the heat exchange channel for shielding water drops is arranged at a top outlet of the heat insulation channel, the top of the heat exchange channel extends into an air outlet in the upper part of the cooling tower shell, and the lower outlet of the heat exchange channel communicates with a rain area.

2. The cooling water-saving device according to claim 1, wherein a support frame is supported on the lower bottom face of the water collecting tank from the ground, and the indirect heat exchange device sequentially penetrates through the water collecting tank, a spray device, a water distribution pipe and a water eliminator from bottom to top.

3. The cooling water-saving device according to claim 2, wherein the water collecting tank comprises a wind shield, a bottom plate and a water receiving tank, a top edge of the wind shield is in closed connection with the inner wall of the cooling tower shell, a bottom edge of the wind shield is connected with the periphery of the bottom plate, the water receiving tank is distributed on the bottom plate, one end of the water receiving tank is connected with a water return pipe, and a through hole is formed in the bottom plate.

4. The cooling water-saving device according to claim 1, wherein an air outlet is formed in a side end face of the upper portion of the heat insulation channel, and the top outlet of the heat insulation channel is covered with the heat exchange channel in a breathable manner.

5. The cooling water-saving device according to claim 2, wherein an air outlet is formed in a side end face of the upper portion of the heat insulation channel, and the top outlet of the heat insulation channel is covered with the heat exchange channel in a breathable manner.

6. The cooling water-saving device according to claim 3, wherein an air outlet is formed in a side end face of the upper portion of the heat insulation channel, and the top outlet of the heat insulation channel is covered with the heat exchange channel in a breathable manner.

7. The cooling water-saving device according to claim 4, wherein the heat exchange channel comprises a closed upper end face, a closed side end face and a through lower end face, and the heat insulation channel comprises a through upper end face, a through lower end face and a side end face with an air outlet formed in the top.

8. The cooling water-saving device according to claim 5, wherein the heat exchange channel comprises a closed upper end face, a closed side end face and a through lower end face, and the heat insulation channel comprises a through upper end face, a through lower end face and a side end face with an air outlet formed in the top.

9. The cooling water-saving device according to claim 6, wherein the heat exchange channel comprises a closed upper end face, a closed side end face and a through lower end face, and the heat insulation channel comprises a through upper end face, a through lower end face and a side end face with an air outlet formed in the top.

10. The cooling water-saving device according to claim 7, wherein the heat exchange channel and the heat insulation channel are circular tubes, rectangular tubes or polygonal tubes.

11. The cooling water-saving device according to claim 8, wherein the heat exchange channel and the heat insulation channel are circular tubes, rectangular tubes or polygonal tubes.

12. The cooling water-saving device according to claim 9, wherein the heat exchange channel and the heat insulation channel are circular tubes, rectangular tubes or polygonal tubes.

13. The cooling water-saving device according to claim 7, wherein the heat exchange channel is made of aluminum, stainless steel, iron or other materials with good heat conduction performance, threaded fins and other devices for strengthening heat exchange and disturbing air and water flow are arranged on the inner side and the outer wall of the heat exchange channel, the equivalent outer diameter of the heat exchange channel is 10-200 mm, the wall thickness of the heat exchange channel does not exceed 2 mm, the length of the heat exchange channel is 2-10 m, the lower end face of the heat exchange channel is at least 200 mm higher than the water surface in the water collecting tank, and the upper end surface of the heat exchange channel is at least 500 mm higher than the top of the water eliminator.

14. The cooling water-saving device according to claim 8, wherein the heat exchange channel is made of aluminum, stainless steel, iron or other materials with good heat conduction performance, threaded fins and other devices for strengthening heat exchange and disturbing air and water flow are arranged on the inner side and the outer wall of the heat exchange channel, the equivalent outer diameter of the heat exchange channel is 10-200 mm, the wall thickness of the heat exchange channel does not exceed 2 mm, the length of the heat exchange channel is 2-10 m, the lower end face of the heat exchange channel is at least 200 mm higher than the water surface in the water collecting tank, and the upper end surface of the heat exchange channel is at least 500 mm higher than the top of the water eliminator.

15. The cooling water-saving device according to claim 9, wherein the heat exchange channel is made of aluminum, stainless steel, iron or other materials with good heat conduction performance, threaded fins and other devices for strengthening heat exchange and disturbing air and water flow are arranged on the inner side and the outer wall of the heat exchange channel, the equivalent outer diameter of the heat exchange channel is 10-200 mm, the wall thickness of the heat exchange channel does not exceed 2 mm, the length of the heat exchange channel is 2-10 m, the lower end face of the heat exchange channel is at least 200 mm higher than the water surface in the water collecting tank, and the upper end surface of the heat exchange channel is at least 500 mm higher than the top of the water eliminator.

16. The cooling water-saving device according to claim 7, wherein the heat insulation channel is made of materials with poor heat conduction performance which include plastics or glass fiber reinforced plastics, the equivalent outer diameter of the heat insulation channel is 5-100 mm, the wall thickness of the heat insulation channel does not exceed 2 mm, the length of the heat insulation channel is 3-11 m, and the length of the portion, extending out of the through hole downwards, of the lower end face is 50-100 mm.

17. The cooling water-saving device according to claim 8, wherein the heat insulation channel is made of materials with poor heat conduction performance which include plastics or glass fiber reinforced plastics, the equivalent outer diameter of the heat insulation channel is 5-100 mm, the wall thickness of the heat insulation channel does not exceed 2 mm, the length of the heat insulation channel is 3-11 m, and the length of the portion, extending out of the through hole downwards, of the lower end face is 50-100 mm.

18. The cooling water-saving device according to claim 9, wherein the heat insulation channel is made of materials with poor heat conduction performance which include plastics or glass fiber reinforced plastics, the equivalent outer diameter of the heat insulation channel is 5-100 mm, the wall thickness of the heat insulation channel does not exceed 2 mm, the length of the heat insulation channel is 3-11 m, and the length of the portion, extending out of the through hole downwards, of the lower end face is 50-100 mm.

19. A wet cooling tower, comprising:

a cooling tower shell, a support frame, a water return pipe, a spray device, a water distribution pipe and a water eliminator being arranged in the cooling tower shell from bottom to top, an air inlet being formed in the bottom of the cooling tower shell, and a cooling water-saving device according to claim 1, wherein the cooling water-saving device is supported on the ground through the support frame, the top of the cooling water-saving device extends into an air outlet in the upper part of the cooling tower shell, a cooling tower air inlet is formed in the lower part of the cooling water-saving device, and a rain area is formed between the cooling water-saving device and the spray device.

20. The wet cooling tower according to claim 19, wherein the support frame is supported on the lower bottom face of the water collecting tank from the ground, and the indirect heat exchange device sequentially penetrates through the water collecting tank, a spray device, a water distribution pipe and a water eliminator from bottom to top.

* * * * *